US006848342B2

(12) United States Patent
Bergfeld, III

(10) Patent No.: US 6,848,342 B2
(45) Date of Patent: Feb. 1, 2005

(54) ADJUSTABLE SELF-LOCKING WRENCH

(75) Inventor: William B. Bergfeld, III, Beatrice, NE (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 10/389,118

(22) Filed: Mar. 14, 2003

(65) Prior Publication Data

US 2004/0177726 A1 Sep. 16, 2004

(51) Int. Cl.[7] ..... B25B 13/24
(52) U.S. Cl. ..... 81/153; 81/145
(58) Field of Search ..... 81/153, 154, 142, 81/143, 145, 148, 149, 129, 129.5

(56) References Cited

U.S. PATENT DOCUMENTS

| | | | | | |
|---|---|---|---|---|---|
| 1,389,487 | A | * | 8/1921 | Cassel | 81/154 |
| 1,621,811 | A | | 3/1927 | Richard et al. | |
| 1,792,338 | A | * | 2/1931 | Walz | 81/145 |
| 2,015,895 | A | * | 10/1935 | Hagbo | 81/143 |
| 2,948,175 | A | * | 8/1960 | Bonkowski | 81/154 |
| 3,505,915 | A | * | 4/1970 | Rydell | 81/355 |
| 3,744,351 | A | * | 7/1973 | Myers | 81/129 |
| 4,375,174 | A | | 3/1983 | Shanley, Jr. | 81/165 |
| 4,735,121 | A | * | 4/1988 | Coulson | 81/129 |
| 5,799,550 | A | | 9/1998 | Hsieh | 81/150 |
| 5,819,608 | A | | 10/1998 | Hsieh | 81/150 |
| 6,116,121 | A | | 9/2000 | Kitt, Jr. | 81/170 |
| 6,324,768 | B1 | | 12/2001 | Wellman | 33/501.05 |
| 6,336,384 | B1 | | 1/2002 | Huang | 81/165 |
| 6,382,056 | B1 | | 5/2002 | Wu | 81/165 |
| 6,418,819 | B1 | | 7/2002 | Kuo | 81/165 |

* cited by examiner

*Primary Examiner*—David B. Thomas
(74) *Attorney, Agent, or Firm*—Dennis J. Williamson; Moore & Van Allen, PLLC

(57) ABSTRACT

An adjustable self-locking wrench is provided. The wrench includes a handle, a base portion having an elongated groove and a locking chamber, a stationary jaw body, a movable jaw having an extension flange, a spring and a locking member. The locking member is movable between a first position wherein the locking member does not tightly contact the extension flange of the movable jaw and a second position wherein the locking member locks the movable jaw in a selected position relative to the stationary jaw.

29 Claims, 7 Drawing Sheets

ADJUSTABLE SELF-LOCKING WRENCH

BACKGROUND

1. Technical Field

The present invention generally relates to an adjustable wrench. In particular, the present invention relates to an adjustable wrench that includes a mechanism to lock a locking member against a movable jaw relative to a stationary jaw.

2. Background of the Invention

A conventional adjustable wrench generally includes an adjusting worm gear that the user rotates with the thumb in order to position a movable jaw with respect to a stationary jaw. Typically, the worm gear is rotatably mounted to the stationary jaw and the worm gear engages teeth formed in a rack extending from the movable jaw. The movable jaw slidably moves along a track defined in the wrench body. The movable jaw may thus be positioned to form a variable clamp space between the movable jaw and the stationary jaw. The lateral engagement of the rack teeth by the worm gear prevents movement of the movable jaw when force is applied to the movable jaw during use. Frequently, this type of conventional adjustable wrench requires readjustment even when engaging objects of the same size, especially when a large force is applied to turn the engaged object. Further, the worm gear must be turned to readjust the jaw gap to engage different-sized objects.

The present invention relates to an adjustable wrench that includes a spring and a locking member that eliminates the need for frequent readjustment for like-sized objects during repetitive applications, yet the wrench of the present invention is easily adjustable to accommodate various-sized objects.

BRIEF SUMMARY

In one aspect of the present invention, an adjustable self-locking wrench is provided. The wrench includes a handle, a base portion having an elongated groove and a locking chamber, a stationary jaw body, a movable jaw having an extension flange, a spring and a locking member. The locking member is movable between a first position wherein the locking member does not tightly contact the extension flange of the movable jaw and a second position wherein the locking member locks the movable jaw in a selected position relative to the stationary jaw.

In another aspect of the invention, a method for turning a plurality of fasteners having engagement heads of different sizes is disclosed. The method includes the step of providing an adjustable having a stationary jaw, a movable jaw, and a wedging mechanism disposed within the wrench, the wedging mechanism includes a locking member. The method further provides the steps of moving the movable jaw so that the jaws are properly spaced to engage a first fastener head, engaging and turning the first fastener head, removing the wrench from the first fastener and moving the locking member to unlock the movable jaw. The movable jaw is then moved relative to the stationary jaw to engage and turn a second fastener.

Advantages of the present invention will become more apparent to those skilled in the art from the following description of the preferred embodiment of the invention which as been shown and described by way of illustration. As will be realized, the invention is capable of other and different embodiments, and its details are capable of modification of various respects. Accordingly, the drawings and description are to be regarded as illustrative in nature and not as restrictive.

DETAILED DESCRIPTION OF THE DRAWINGS AND THE PRESENTLY PREFERRED EMBODIMENTS

Figure 1:
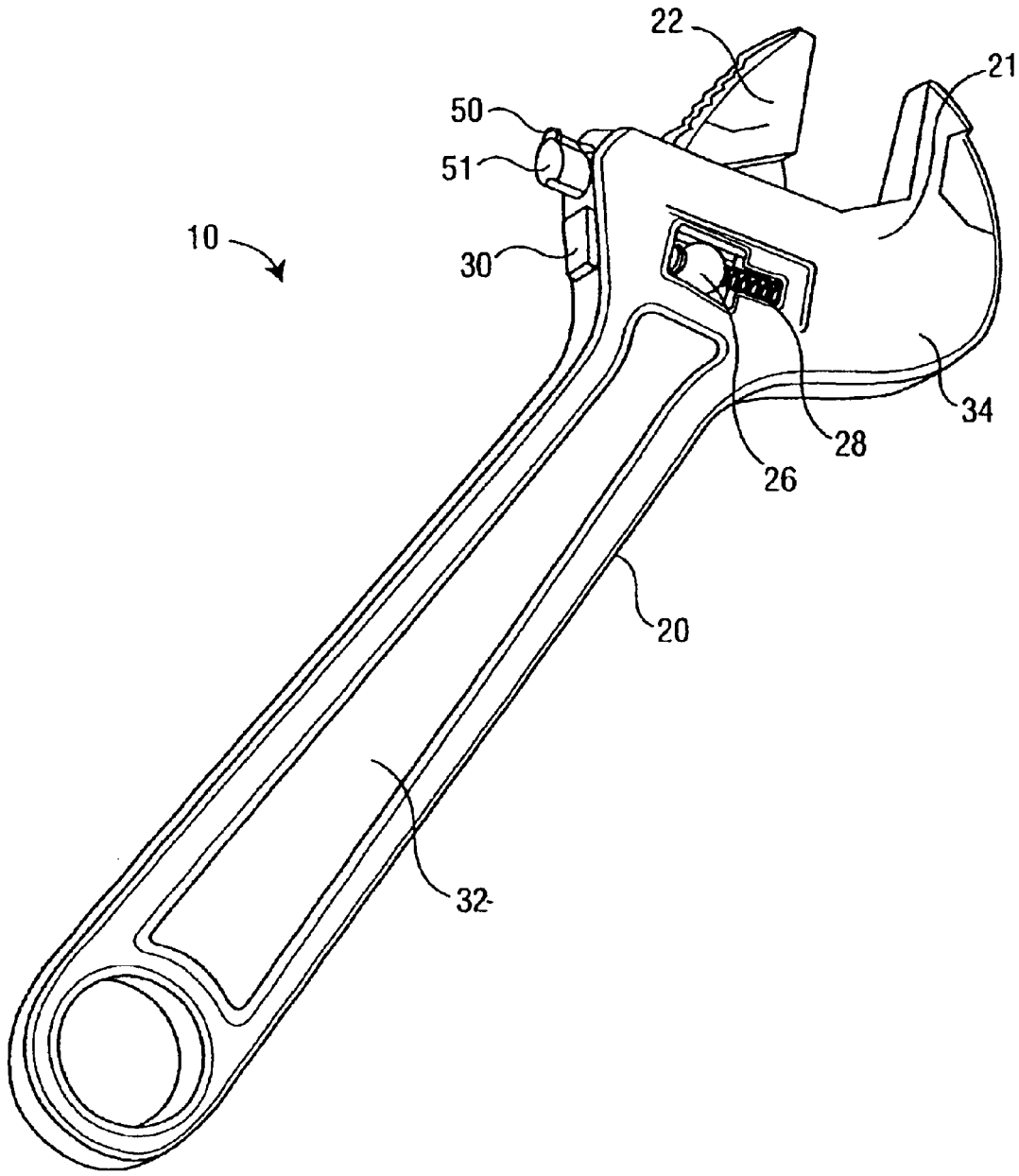
FIG. 1 is a perspective view of an adjustable wrench in accordance with the present invention.
Figure 2:
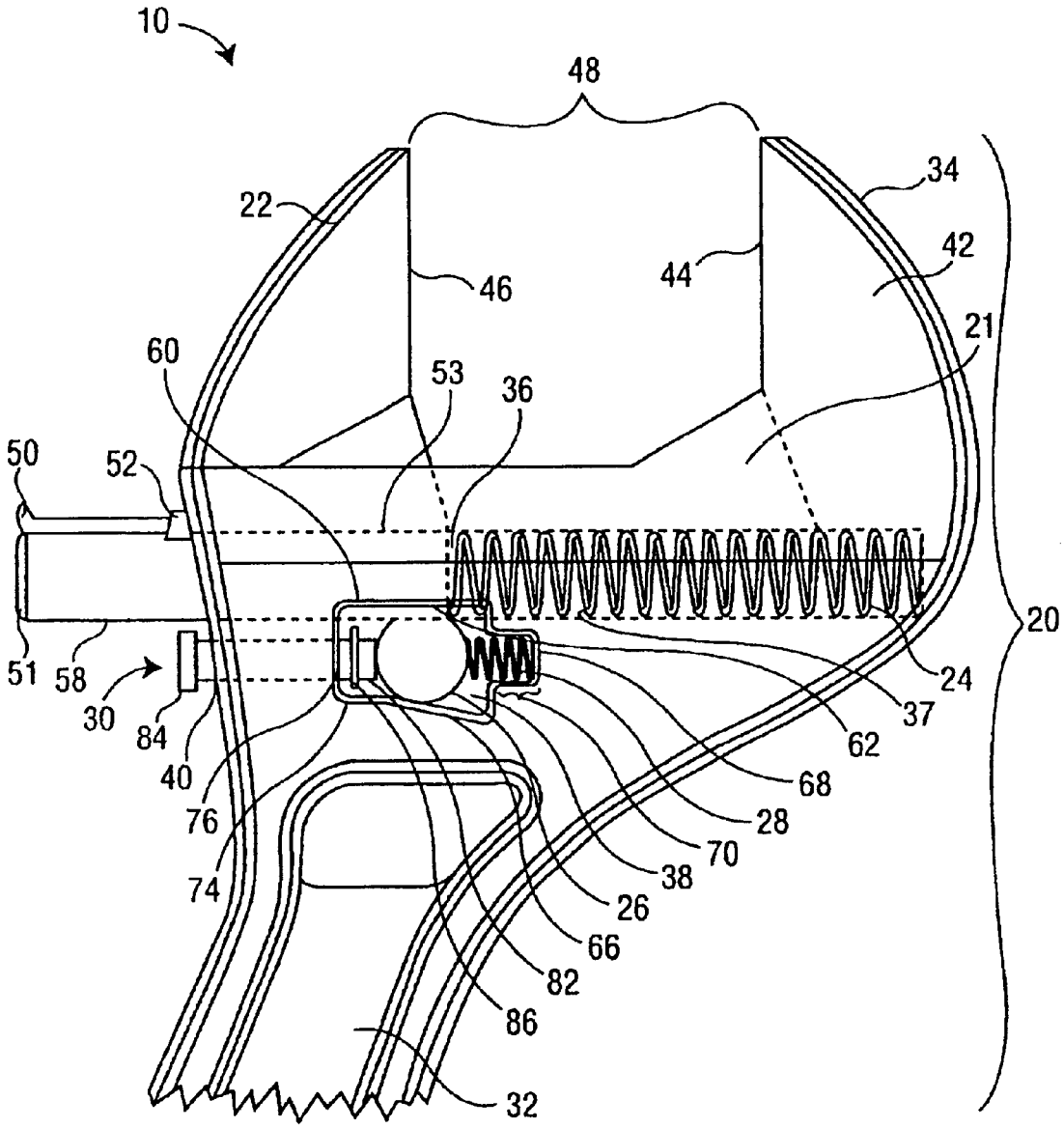
FIG. 2 is a top view in section in an enlarged scale of a part of the adjustable wrench shown in FIG. 1 in accordance with the present invention.

FIGS. 1–6 illustrate a preferred embodiment of an adjustable, self-locking wrench. An adjustable wrench 10 is illustrated in FIGS.1 and 2 and generally comprises a body 20 having a base portion 21, stationary jaw 34, a movable jaw 22, a spring 24, a locking member 26, a spring 28 and a release pin 30. As shown, the body 20 comprises an elongated handle 32 for gripping the wrench 10 when in use, although any handle may be used for the wrench 10. The handle may be made of metal or alternatively, the handle may be made of any material commonly known in the art. The movable jaw 22 includes an extension flange 50 having an elongated and bulbous terminal edge 51. A view of the movable jaw 22 removed from the rest of the wrench may be seen in FIG. 6.

As shown in FIG. 2, the body 20 also comprises a base portion 21 and a stationary jaw 34 attached thereto. A groove 36 is defined in a top portion of the base portion 21, and a generally cylindrical channel 37 is defined inside the base portion below and in common with the groove 36. A locking chamber 38 and an opening 62 in common with the locking chamber 38 are defined within a face of the base portion 21. In the alternative, the locking chamber 38 and an opening 62 in common with the locking chamber 38 may be defined in the interior of the base portion. The stationary jaw 34 extends outwardly from the handle 32 at a first end 42 of the body 20. The groove 36 and the channel 37 extend generally perpendicular to and coplanar with a face 44 of the stationary jaw 34 across the first end 42 of the body 20. The groove 36 and the channel 37 are adapted to slidably receive the extension flange 50 and the bulbous terminal edge 51 of the movable jaw 22, respectively. The movable jaw 22 extends outwardly from the channel 37 at the first end 42, generally coplanar with the stationary jaw 34. The groove 36 and the channel 37 preferably define a direction of travel for the movable jaw 22.

Figure 4:
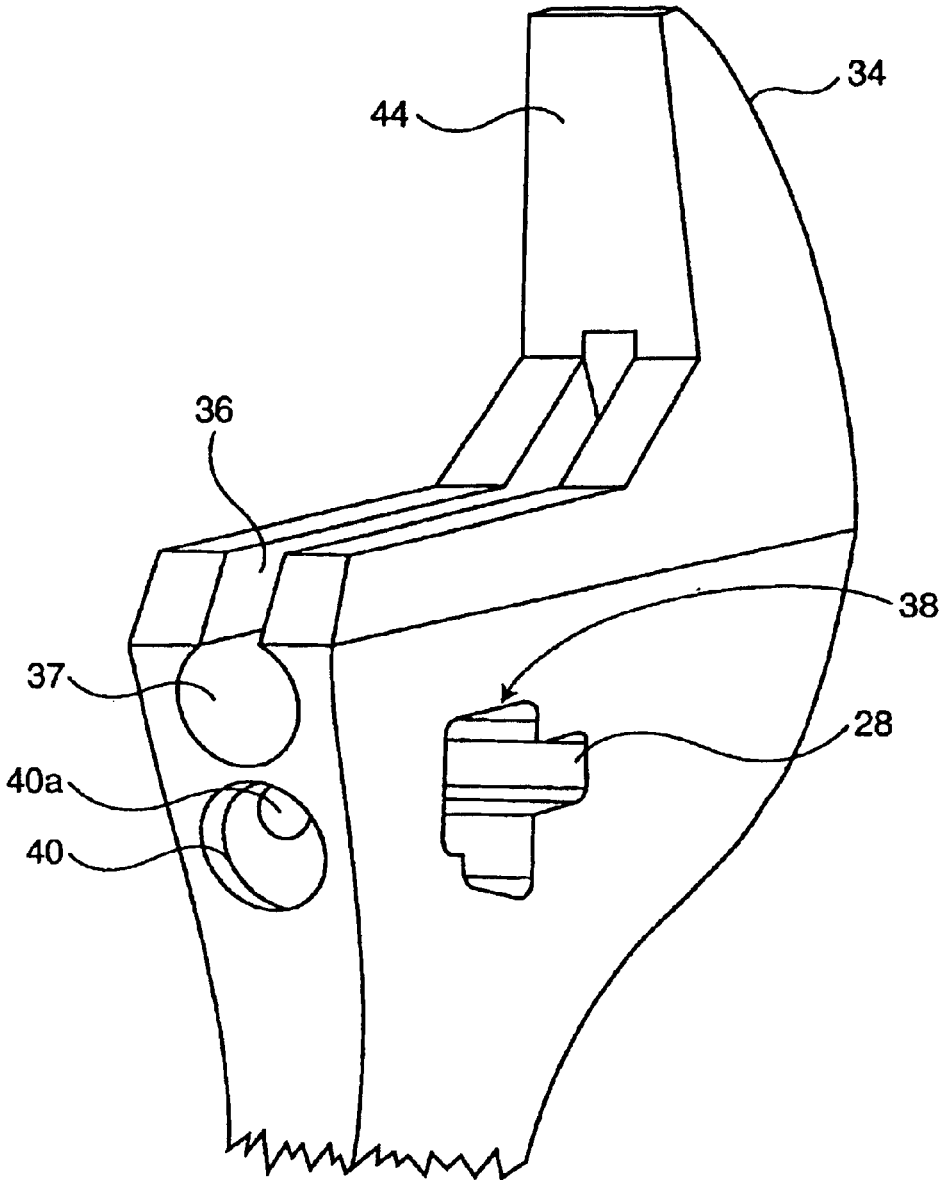
FIG. 4 is a perspective view of a portion of the head of the adjustable wrench shown in the previous Figures, with the movable jaw and other parts removed for clarity.
Figure 5:
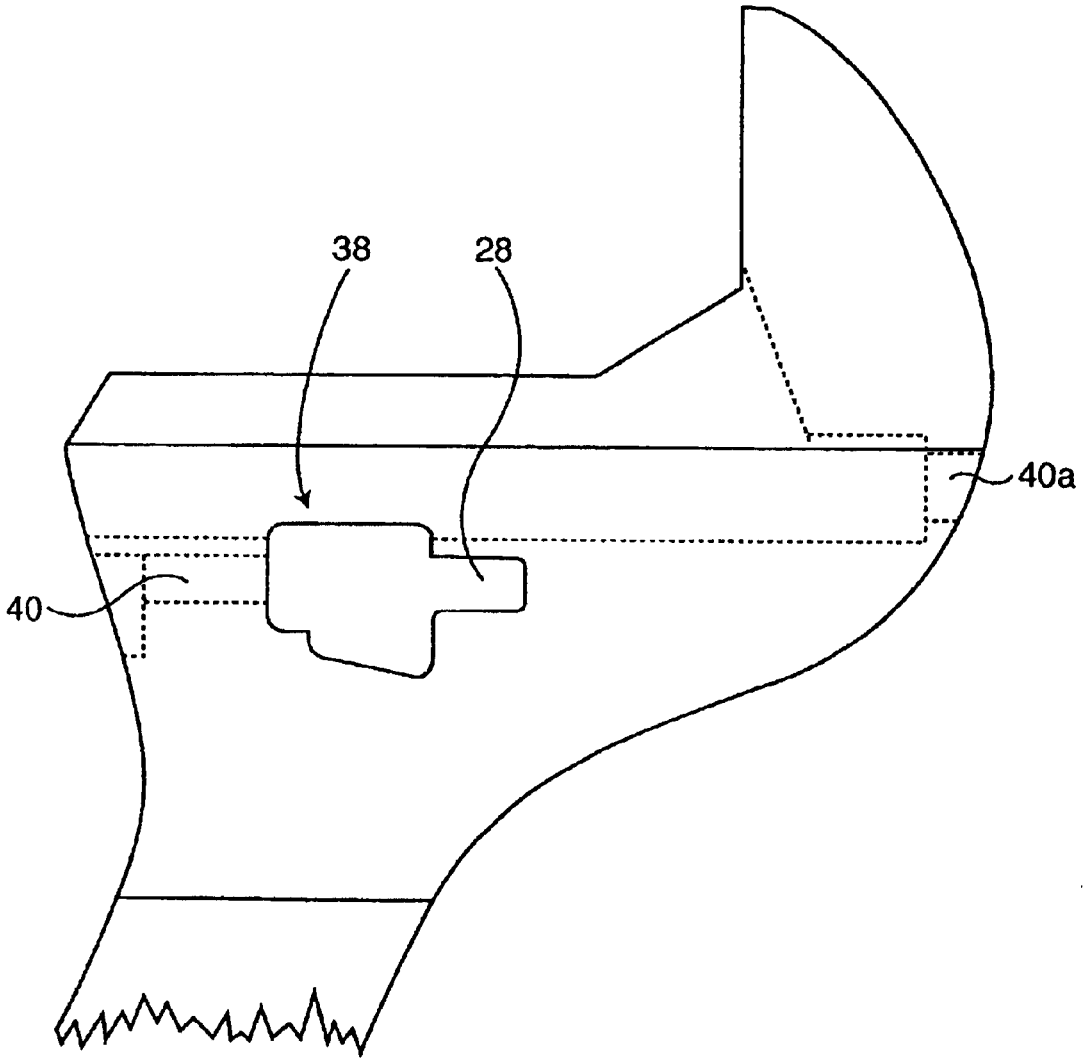
FIG. 5 is a side view of the simplified embodiment of FIG. 4.
Figure 6:
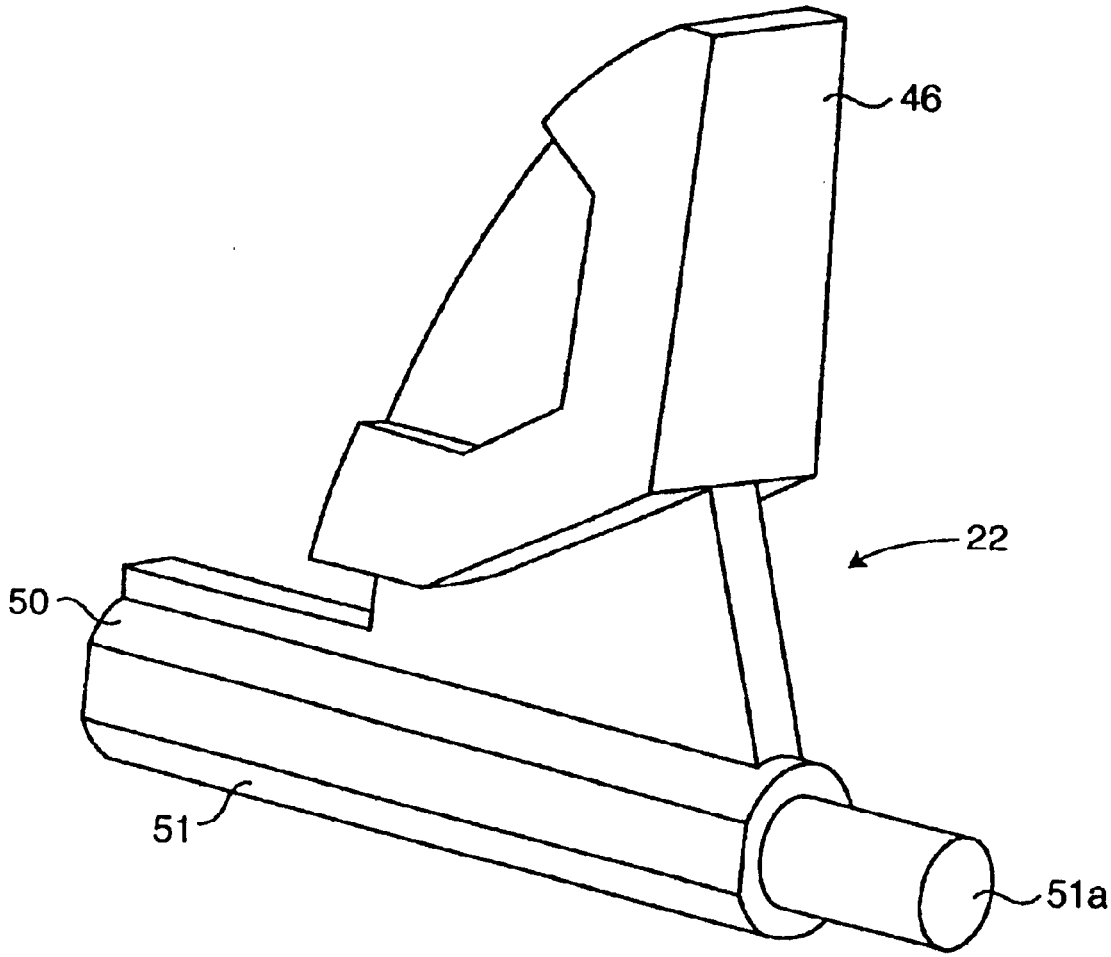
FIG. 6 is a perspective view of the moveable jaw portion of the embodiment of the wrench, removed from the remainder of the wrench for clarity.
Figure 7:
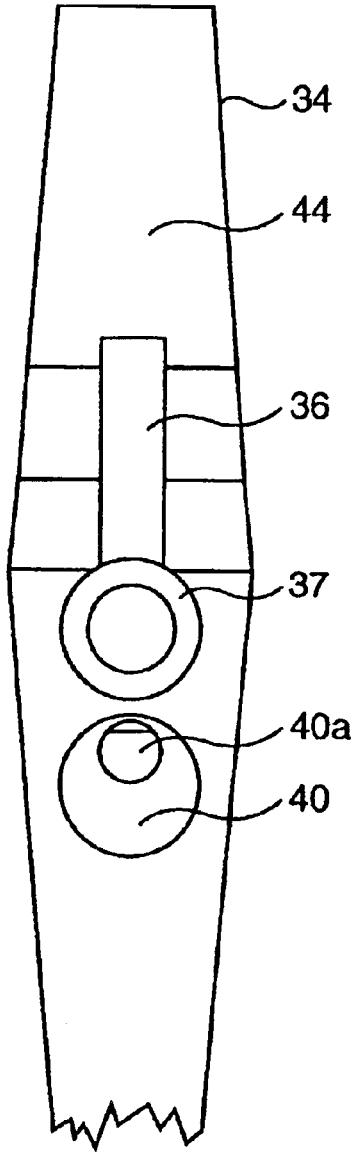
FIG. 7 is a side view of the simplified embodiment of FIG. 4.

As shown in this Figure and in FIGS. 4, 5 and 7, the stationary jaw 34 includes the inner face 44 and the movable jaw 22 includes an inner face 46. Together the faces 44 and 46 of the respective jaws 34 and 22 define a variable clamp space 48 to grip an object to be secured by the wrench 10. The extension flange 50 of the movable jaw 22 traverses along the groove 36 and the channel 37 in the direction of travel to adjust the width of the variable clamp space 48 depending on the size of the object to be gripped. The faces 44 and 46 move and remain parallel to each other. The movable jaw 22 may be locked at any position along the channel 37 to define the variable clamp space 48 as described below. The bulbous terminal edge 51 is adapted to prevent the movable jaw 22 from coming out of the channel 37 and provide a wedging surface to bear the force of the locking mechanism's locking member 26. In a preferred embodiment, the channel 37 may be U-shaped and adapted to slidably receive the bulbous terminal edge 51 of the movable jaw 22.

The spring 24 abuts the terminal edge 51 of the extension flange 50 of the movable jaw 22 and the spring 24 biases the movable jaw 22 to the open position with respect to the stationary jaw 34. The spring 24 may be disposed within the channel 37 formed within the base portion 21 of the body 20. Preferably, to retain the spring 24 in proper position within the channel and abutting the end of the terminal edge 51 as shown, a rounded cylindrical extension 51*a* extends outwardly from the end of the terminal edge 51. The extension 51*a* may be of any shape, but is preferably sized to fit within the coil spring 24 and retain a portion of the spring thereon. The extension 51*a* is sized to fit within a smaller through-opening 40*a* defined in an end of the channel 37. Preferably the cross-sectional shape of the opening 40*a* is sized to closely fit around the extension 51*a* and at least a portion of the spring 24. In this configuration, the spring 24 within the channel 37 biases the movable jaw 22 to the open position along the channel 37. The preferred channel 37, as shown in FIG. 2, is generally cylindrically shaped and adapted to receive a generally cylindrically shaped spring 24. Of course, the channel 37 and the spring 24 may be any shape.

The motion of the movable jaw 22 along the groove 36 and the channel 37 to define the variable clamp space 48 is controlled by the spring 24 in the channel 37 and by the force of the user pressing on the movable jaw 22. The bias of the spring 24 against the movable jaw 22 expands the variable clamp space 48. The spring 24 may bias the movable jaw 22 away from the stationary jaw 34 to a maximum width for the variable clamp space 48. The spring 24 exerts sufficient force against the movable jaw 22 to open the variable clamp space 48 to the maximum width as determined by the length of the groove 36 and the channel 37. To decrease the variable clamp space 48, the user may press on the movable jaw 22 against the bias of the spring 24 in the channel 37 and toward the stationary jaw 34 along the groove 36 and the channel 37.

In order to prevent the movable jaw 22 from being forced out of the end of the groove 36 and the channel 37 by the bias of the spring 24, the channel 37 may be swedged shut at a groove opening 52 in the body 20 after the spring 24 and the movable jaw 22 have been assembled in the channel 37. Alternatively, any means known in the art may be used to prevent the movable jaw 22 from being forced out of the end of the channel 37 by the spring 24 thereby retaining the movable jaw 22 in the channel 37 of the body 20.

As shown in the preferred embodiment in FIG. 2, the movable jaw 22 may be held in any position along the groove 36 by the locking member 26. The locking member 26 is received within the locking chamber 38 defined within body 20. The locking chamber 38 includes a top wall 60 substantially parallel to the groove 36 and the channel 37 and with an opening 62 that allows communication between the locking member 26 within the locking chamber 38 and the bottom of the terminal edge 51 of the movable jaw 22. The locking chamber 38 further includes a bottom wall 66 that is downwardly angled with respect to the plane of the top wall 60. The bottom wall 66 may include a track adapted to retain the locking member within position in the locking chamber 38. A first side wall 68 of the locking chamber 38 includes a recess 70 adapted to receive the spring 28. A second side wall 74 includes an opening 76 that is adapted to receive a release pin 30. The locking member 26 abuts the movable jaw 22, through the opening 62, to hold the movable jaw 22 in position along the channel 37. The spring 28 within the locking chamber 38 biases the locking member 26 against a bottom surface 58 of the bulbous terminal edge 51 of the movable jaw 22. The locking member 26 is biased against the surface 58 when the locking member 26 is tightly wedged between the bulbous terminal edge 51 and the bottom wall 66. This in turn urges the cylindrical terminal, edge 51 against the upper surface 53 of the interior of the channel 37. In this locked position, any outward bias by the spring 24 or by wrench operation retains the locking member in this locked position and tightens it against the movable jaw 22. The spring 28 urges the locking member toward this wedged, locked position.

The locking member 26 may be in the shape of a ball, a cylinder, a wedge or any shape capable of being biased against the surface 58 of the bulbous terminal edge 51 to hold the movable jaw 22 in position along the channel 37. The spring 28 may alternatively be a resilient plastic member adapted to bias the locking member 26 against the surface 58 of the movable jaw 22 or any spring member adapted to bias the locking member 26 against the surface 58 of the movable jaw 22.

Figure 3:
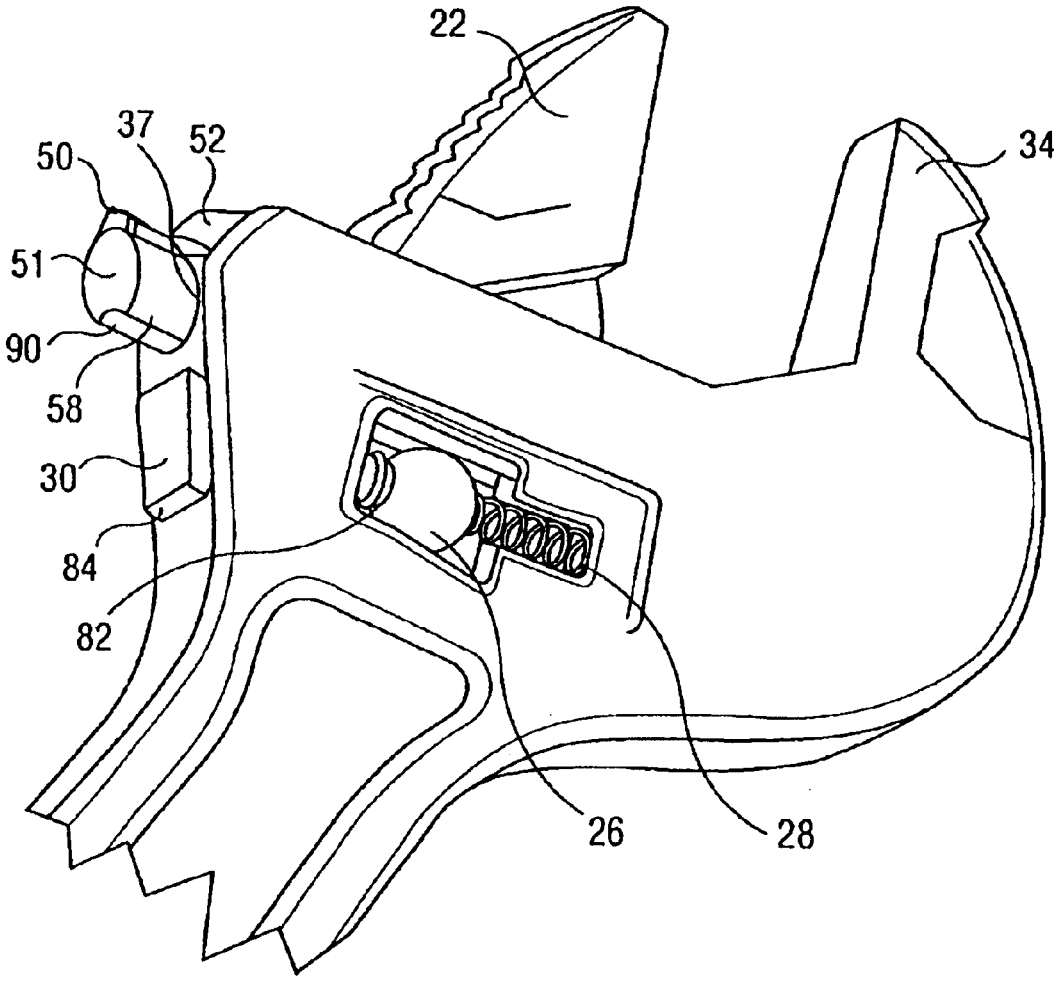
FIG. 3 is a top perspective view in an enlarged scale of a part of the adjustable wrench shown in FIG. 1 in accordance with the present invention.

FIG. 3 illustrates a preferred embodiment of the wrench 10 with the locking member 26 biased against the surface 58 of the bulbous terminal edge 51. As shown, the surface 58 includes a radial cut 90, extending along the length of the surface 58, that is adapted to receive the locking member 26 when the locking member 26 is biased against the surface 58 by the spring 28. The radial cut 90 maintains the position of the locking member 26 along the directions parallel and perpendicular to the groove 36 and the channel 37 to maintain the bias of the locking member 26 against the surface 58. When an alternatively shaped locking member is biased against the surface 58 of the movable jaw 22, the surface 58 may be flat or the surface 58 may be otherwise contoured to be adapted to receive and retain the alternatively shaped locking member to maintain the bias of the locking member against the surface 58.

A release pin mechanism may be used to release the locking member 26 from the locking position and push the locking member 26 into an unwedged, released position. FIGS. 2 and 3 illustrate the release pin 30 of the preferred embodiment of the present invention. As shown in FIG. 2, a first end 82 of the pin 30 communicates with the locking member 26 through the opening 40 in the body 20. The pin 30 is depressed by the user at a second end 84 to release the locking member 26 from the biased position against the surface 58 of the movable jaw 22. When the user depresses the second end 84 of the pin 30, the pin 30 moves the locking member 26 out of communication with the surface 58 of the movable jaw 22, thereby allowing the movable jaw 22 to change position with respect to the stationary jaw 34. The spring 24 then is allowed to bias the movable jaw 22 away from the stationary jaw 34, thereby enlarging the variable clamp space 48. When the user releases the pin 30, the spring 28 resumes the bias against the locking member 26 which in turn resumes the bias against the surface 58 to lock the movable jaw 22 in position along the channel 37 with respect to the stationary jaw 34. The user may depress the second end 84 of the pin 30 until the spring 24 biases the movable jaw 22 against the point at which the opening 52 is swedged shut resulting in the maximum width opening defined by the variable clamp space 48. Alternatively, the user may release the pin 30 and the locking member 26 will return to biased communication against the surface 58 to position the movable jaw 22 at any position along the groove 30 to form the desired variable clamp space 48.

As shown in FIG. 2 the pin 30 is held in the opening 40 by a clip 86 that prevents the pin 30 from being removed from the body 20 through the opening 40. Alternatively, the pin 30 may be swedged at the first end 82 to prevent the pin 30 from being removed through the opening 40 of the body 20. Any means known in the art for retaining the pin 30 within the opening 40 and allowing mobility of the pin 30 to contact the locking member 26 may be used.

A cover (not shown) may be used to enclose the locking chamber 38. The locking chamber 38 may be formed from a hole defined through the body 20 or, alternatively, the locking chamber may be formed in the body 20 with one side of the locking chamber open to the exterior of the body 20. A cover may enclose one or both sides of the locking chamber 38 thereby enclosing the locking member 26 and the spring 28 within the body 20.

It is therefore intended that the foregoing detailed description be regarded as illustrative rather than limiting, and that it be understood that it is the following claims, including all equivalents, that are intended to define the spirit and scope of this invention.

What is claimed is:

1. An adjustable wrench comprising:

a handle;

a base portion defined on said handle, said base portion defining an elongated groove and a portion of a locking chamber lower wall;

a stationary jaw attached to said base portion, said stationary jaw having an inside face;

a movable jaw mounted to said base portion for slidable movement in a direction of travel, said movable jaw having an inside face and an extension flange, said extension flange received at least partially within said groove and having an exposed portion exposed to said locking chamber;

a first spring positioned to bias said moveable jaw away from said stationary jaw; and a locking member disposed within said locking chamber between said lower wall and said exposed portion of said extension flange, said locking member being movable between a first position and a second position, wherein said locking member does not tightly contact said lower wall and said exposed portion when in said first position, and said locking member is positioned to provide wedging between said lower wall and said exposed portion when in said second position to lock said movable jaw in a selected position relative to said stationary jaw and wherein said locking member is of a shape to allow said locking member to roll along at least portion of said wedging mechanism.

2. The wrench of claim 1 wherein said lower wall of said locking chamber extends at an angle relative to the direction of travel of said movable jaw.

3. The wrench of claim 1 further comprising an elongated retention passage defined adjacent to said groove and extending substantially parallel to the direction of travel of said movable jaw, and said extension flange further comprising a bulbous edge portion having a cross sectional area for close reception within said elongated retention passage.

4. The wrench of claim 3 wherein said locking member, when in said second position, urges said bulbous edge portion against an upper wall of said retention passage to lock said movable jaw in place.

5. The wrench of claim 4 wherein a bottom portion of said bulbous edge portion of said extension flange is contoured to receive said locking member.

6. An adjustable wrench comprising:

a handle;

a base portion defined on said handle, said base portion defining an elongated groove and a portion of a locking chamber lower wall;

a stationary jaw attached to said base portion, said stationary jaw having an inside face;

a movable jaw mounted to said base portion for slidable movement in a direction of travel, said movable jaw having an inside face and an extension flange, said extension flange received at least partially within said groove and having an exposed portion exposed to said locking chamber;

a first spring positioned to bias said moveable jaw away from said stationary jaw;

an elongated retention passage defined adjacent to said groove and extending substantially parallel to the direction of travel of said movable jaw, and said extension flange further comprising a bulbous edge portion having a cross sectional area for close reception within said elongated retention passage; and a locking member disposed within said locking chamber between said lower wall and said exposed portion of said extension flange, said locking member being movable between a first position and a second position wherein said locking member urges said bulbous edge portion against an upper wall of said retention passage to lock said movable jaw in place, wherein said locking member does not tightly contact said lower wall and said exposed portion when in said first position, and said locking member is positioned to provide wedging between said lower wall and said exposed portion when in said second position to lock said movable jaw in a selected position relative to said stationary law;

wherein a bottom portion of said bulbous edge portion of said extension flange is contoured to receive said locking member;

and wherein said locking member is spherical in shape.

7. The wrench of claim 6 wherein said contour is arcuate in cross-section.

8. The wrench of claim 6 wherein said lower wall of said locking chamber is contoured to retain said locking member.

9. The wrench of claim 8 wherein said lower wall is arcuate or U-shaped in cross-section.

10. The wrench of claim 1 further comprising a releasing passage defined within said base portion, said releasing passage having a first opening into said locking chamber.

11. The wrench of claim 10 further comprising a releasing pin having a first end and a second end, said pin slidably mounted within said releasing passage and positioned wherein said first end is able to selectively move said locking member away from said second position towards said first position, thereby releasing said movable jaw.

12. The wrench of claim 11 further comprising a second spring urging said locking member against said extension flange.

13. The wrench of claim 11 wherein said second end of said pin extends out of said releasing passage external to said wrench.

14. A method of turning a plurality of fasteners having engagement heads of differing sizes, said method comprising the steps of:

providing a adjustable wrench having a stationary jaw fixedly mounted to a base portion defining an elongated passage and a movable jaw slidable relative thereto, said movable jaw being urged away from said stationary jaw by a spring and having a lower portion engaged within said elongated passage, and a wedging mechanism disposed within said wrench, said wedging mechanism having a locking member disposed within a locking chamber for movement between a released position and a position wherein said locking member is wedged between said lower portion of said movable jaw and said base portion, thereby locking said movable jaw and wherein said locking member is of a shape to allow said locking member to roll along at least portion of said wedging mechanism;

moving said movable jaw so that said jaws are properly spaced to engage a first fastener head;

engaging said first fastener head with said wrench jaws;

turning said first fastener by turning said engaged wrench;

removing said wrench from said first fastener;

moving said locking member to said released position to unlock said movable jaw;

moving said movable jaw so that said jaws are properly spaced to engage a second fastener head, wherein said second fastener head is a different size than said first fastener head;

engaging said second fastener head with said wrench jaws; and turning said second fastener head with said wrench.

15. The method of claim 14 wherein said movable jaw is biased away from said stationary jaw.

16. The method of claim 15 wherein said locking member is movable via a release pin slidably mounted to said wrench.

17. An adjustable wrench comprising:

a base portion;

a stationary jaw fixedly mounted to said base portion, said base portion defining an elongated passage;

a movable jaw having a lower portion slidably mounted within said elongated passage for movement relative to the base portion;

a spring mounted to bias said movable jaw away from said stationary jaw;

a wedging mechanism disposed within said base portion, said wedging mechanism having a locking member disposed within a locking chamber for movement between a released position and a position wherein said locking member is wedged between said lower portion of said movable jaw and said base portion;

wherein said locking member is of a shape to allow said locking member to roll along at least portion of said wedging mechanism.

18. The wrench of claim 17 wherein said locking chamber further comprises a lower wall, said lower wall extends at an angle relative to the direction of travel of the movable jaw.

19. The wrench of claim 17 further comprising an elongated retention passage defined adjacent to said groove and extending substantially parallel to the direction of travel of said movable jaw, and said extension flange further comprising a bulbous edge portion having a cross sectional area for close reception within said elongated retention passage.

20. The wrench of claim 19 wherein said locking member, when in said second position, urges said bulbous edge portion against an upper wall of said retention passage to lock said movable jaw in place.

21. The wrench of claim 19 wherein a bottom portion of said bulbous edge portion of said extension flange is contoured to receive said locking member.

22. An adjustable wrench comprising:

a base portion;

a stationary jaw fixedly mounted to said base portion, said base portion defining an elongated passage;

a movable jaw having a lower portion slidably mounted within said elongated passage for movement relative to the base portion;

a spring mounted to bias said movable jaw away from said stationary jaw;

an elongated retention passage defined adjacent to said groove and extending substantially parallel to the direction of travel of said movable jaw, and said extension flange further comprising a bulbous edge portion having a cross sectional area for close reception within said elongated retention passage; and a wedging mechanism disposed within said base portion, said wedging mechanism having a locking member disposed within a locking chamber for movement between a released position and a position wherein said locking member is wedged between said lower portion of said movable jaw and said base portion;

wherein a bottom portion of said bulbous edge portion of said extension flange is contoured to receive said locking member and wherein said locking member is spherical in shape.

23. The wrench of claim 22 wherein said contour is arcuate in cross-section.

24. The wrench of claim 22 wherein said lower wall of said locking chamber is contoured to retain said locking member.

25. The wrench of claim 24 wherein said lower wall is arcuate or U-shaped in cross-section.

26. The wrench of claim 17 further comprising a releasing passage defined within said base portion, said releasing passage having a first opening into said locking chamber.

27. The wrench of claim 26 further comprising a releasing pin having a first end and a second end, said pin slidably mounted within said releasing passage and positioned wherein said first end is able to selectively move said locking member away from said second position towards said first position, thereby releasing said movable jaw.

28. The wrench of claim 27 further comprising a second spring urging said locking member against said extension flange.

29. The wrench of claim 27 wherein said second end of said pin extends out of said releasing passage external to said wrench.

* * * * *